US008251362B2

(12) United States Patent
Konishi

(10) Patent No.: US 8,251,362 B2
(45) Date of Patent: Aug. 28, 2012

(54) SHEET STACKING APPARATUS AND IMAGE FORMING SYSTEM USING THE SAME

(75) Inventor: Hiroyuki Konishi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 211 days.

(21) Appl. No.: 12/409,053

(22) Filed: Mar. 23, 2009

(65) Prior Publication Data

US 2009/0243198 A1 Oct. 1, 2009

(30) Foreign Application Priority Data

Mar. 27, 2008 (JP) ..... 2008-083127

(51) Int. Cl.
*B65H 39/00* (2006.01)

(52) U.S. Cl. ..... 270/58.17; 270/58.12; 270/58.16; 270/58.27

(58) Field of Classification Search ..... 270/58.11, 270/58.12, 58.16, 58.17, 58.27
See application file for complete search history.

(56) References Cited

U.S. PATENT DOCUMENTS

| | | | | |
|---|---|---|---|---|
| 5,938,192 | A * | 8/1999 | Kosasa | 271/221 |
| 6,371,472 | B1 * | 4/2002 | Miyake et al. | 270/58.14 |
| 7,134,659 | B2 * | 11/2006 | Sato et al. | 271/265.01 |
| 7,300,052 | B2 * | 11/2007 | Tamura et al. | 271/221 |
| 7,413,178 | B2 * | 8/2008 | Fujii et al. | 270/58.11 |

FOREIGN PATENT DOCUMENTS

JP 2002-211829 A 7/2002

* cited by examiner

*Primary Examiner* — Leslie A Nicholson, III
(74) *Attorney, Agent, or Firm* — Holtz, Holtz, Goodman & Chick, PC

(57) ABSTRACT

A sheet stacking apparatus, including: a stacking section which stacks sheets; a sorting section which changes an ejecting position of the sheet in the stacking device to sort the sheets; an aligning section which aligns the sheet sorted by the sorting section and ejected onto the stacking section; a shifting section which shifts the aligning section based on the ejecting position changed by the sorting section in the stacking section; and a control section which controls at least the aligning section and the shifting section; wherein when the number of sheets as a sheet unit to be sorted by the sorting section is plural, the control section controls the aligning section to align the sheets as the sheet unit, and when the number of sheets is singular, the control section controls at least the aligning section and shifting section not to align the single sheet in the sheet unit.

5 Claims, 11 Drawing Sheets

SHEET STACKING APPARATUS AND IMAGE FORMING SYSTEM USING THE SAME

CROSS REFERENCE TO RELATED APPLICATION

This application is based on Japanese Patent Application No. 2008-083127 filed on Mar. 27, 2008, with the Japanese Patent Office, the entire content of which is hereby incorporated by reference.

TECHNICAL FIELD

The present invention relates to a sheet stacking apparatus including a sheet sorting function and a sheet aligning function, and an image forming system including said sheet stacking apparatus.

BACKGROUND OF THE INVENTION

Concerning the sheet stacking apparatus, which is combined with the image forming apparatus, such as a copy machine or a printer, to eject a large number of sheets, many said devices have the sheet sorting function to change a sheet ejecting position for sorting such sheets. Further, many said devices have the sheet aligning function to align the plural sorted sheets.

The sheet stacking apparatuses, including the sheet sorting function and the sheet aligning function, are configured to sort the sheets at two positions, which are at the front side and the rear side of the sheet stacking apparatuses. In case of aligning the sorted sheets, an aligning plate is shifted to a sorting position, where the sheet aligning operation is being conducted.

Before the sheets to be aligned are dispatched to a sheet ejection tray, if a shifting operation of the aligning plate is completed, the aligning operation of the sheets can be properly conducted. However, if the shifting operation of the aligning plate is not completed, the aligning operation of the sheets cannot be properly conducted, and sometimes the sheet aligning plate interferes in ejecting the sheets.

The Unexamined Japanese Patent Application Publication Number 2002-211, 829 discloses a technology to overcome the above problems, in which even though an image forming speed of the image forming apparatus is not lowered, a sheet conveyance speed of the sheet stacking apparatus is lowered, so that the conveyance interval between separating sheets to be sorted is increased. According to this technology, since the conveyance clearance between separating sheets to be sorted is greater, the time period for shifting the aligning plate is certainly secured, whereby the aligning operation can be properly conducted.

However, in the above described technology, in which the sheet conveyance speed is lowered, and the sheet conveyance interval is increased, when plural greater conveyance intervals are to be provided (that is, when the number of sheets to be sorted as a single unit is relatively small, and said units are in the series), the conveyance route of the sheet stacking apparatus becomes full with sheets, so that the sheet stacking apparatus cannot receive the sheets which are ejected from the image forming apparatus. Accordingly, depending on circumstances, the image forming speed of the image forming apparatus needs to be lowered, which is a problem from the point of view of the productivity conducted by the image forming apparatus.

To overcome the above problem, a technology is conceivable in which plural sheets are temporarily stacked on the sheet stacking apparatus, so that the plural sheets remain in the conveyance route of the sheet stacking apparatus, whereby the conveyance interval of the separating sheets to be sorted is increased. However, if the number of sheets to be sorted as a unit is only one, said sheet is included within another unit, that is, said sheet cannot be temporarily stacked alone. Accordingly, in the above technology, the image forming speed of the image forming apparatus must be lowered, which is also a problem from the point of view of the productivity conducted by the image forming apparatus.

Further, considering the sheets to be sorted, if the number of sheets to be sorted as a single unit is plural, the plural sheets are necessary to be aligned in the unit, but if the number of sheets to be sorted as a single unit is singular, said single sheet is not necessary to be aligned in the unit.

SUMMARY OF THE INVENTION

The sheet stacking apparatus relating to the present invention includes:

a stacking section which is configured to stack sheets ejected outside;

a sorting section which is configured to change a sheet ejecting position on the stacking section to sort the sheets;

an aligning section which is configured to align the sheet which was sorted by the sorting section and ejected onto the stacking section;

a shifting section which is configured to shift the aligning section based on the sheet ejecting position on the stacking section; and a control section which is configured to control at least the aligning section and shifting section, wherein when the number of sheets included in a single sheet unit to be sorted by the sorting section is plural, the control section controls the aligning section to align the sheets in the single sheet unit, and when the number of sheets included in the single sheet unit to be sorted by the sorting section is singular, the control section controls at least the aligning section and shifting section not to align the single sheet in the single sheet unit.

Further, an image forming system relating to the present invention includes:

the sheet stacking apparatus; and an image forming apparatus which conveys the sheet to the sheet stacking apparatus, after the image forming apparatus has formed an image on the sheet.

BRIEF DESCRIPTION OF THE DRAWINGS

Embodiment will now be described, by way of example only, with reference to the accompanying drawings which are meant to be exemplary, not limiting, and wherein like elements are numbered alike in several Figures, in which:

FIG. 5(*b*) is the top view of a main tray;

DETAILED DESCRIPTION OF THE PREFERRED EMBODIMENTS

Brief Description of the Image Forming System

Figure 1:
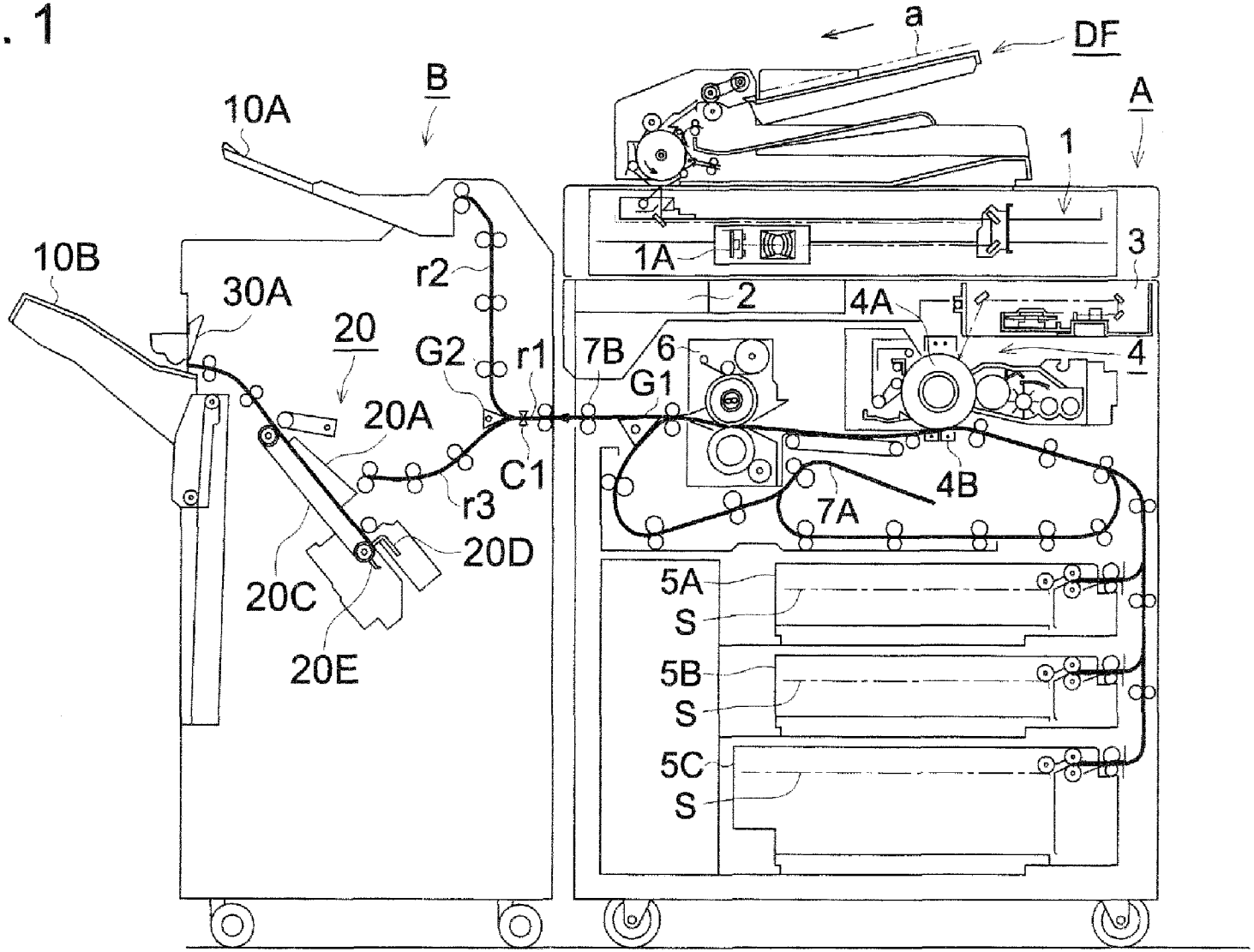
FIG. 1 shows the total structure of an image forming system.

FIG. 1 shows the total structure of the image forming system, which includes image forming apparatus A, automatic document feeding device DF, and sheet stacking apparatus B.

Image forming apparatus A shown in FIG. 1 includes image reading section 1, image processing section 2, image writing section 3, and image forming section 4. Automatic document feeding device DF is mounted on a top portion of image forming apparatus A, and sheet stacking apparatus B is combined to the left side of image forming apparatus A.

Document "a", placed on a document reading plate of automatic document reading device DF, is fed in the arrowed direction, whereby, images, carried on a single surface or both surfaces of document "a", are read by image sensor 1A of image reading section 1. Analog signals, photo-electrically converted by image sensor 1A, are processed by image processing section 2, with respect to analog processing, A/D conversion, shading correction, and image compression, whereby said processed signals are sent to image writing section 3. In image writing section 3, laser rays, emitted from a semiconductor laser, are radiated onto photoconductor drum 4A of image forming section 4, whereby latent images are formed on photoconductor drum 4A.

In image forming section 4, various processes are conducted, such as an electrical charging process, an exposure process, a development process, an image transfer process, a sheet separating process, and a drum cleaning process. Image transfer section 4B transfers images onto sheet S, which was conveyed from sheet supplying cassettes 5A-5C. After image fixing section 6 fixes the images on sheet S, sheet S carrying the fixed images is conveyed to sheet stacking section B through sheet ejection section 7B. In case of a double-surfaces printing process, after sheet S is conveyed to double-surfaces sheet supplying section 7A by conveyance route switching gate G1, images are formed on the reverse surface of sheet S by image forming section 4, and sheet S is finally ejected onto sheet stacking section B through sheet ejecting section 7B.

Sheet stacking apparatus B ejects sheets S, conveyed from image forming apparatus A, onto upper tray 10A or main tray 10B (being a sheet stacking section), so that sheets S are stacked on upper tray 10A or main tray 10B. Further, sheet stacking apparatus B includes a sheet sorting function and a sheet aligning function, whereby sheets S, stacked on main tray 10B, are sorted as a unit and aligned.

Sheet S, conveyed into sheet stacking apparatus B, is detected by inlet sensor C1, mounted on conveyance route r1. By using said inlet sensor C1, sheet stacking apparatus B can detect that a sheet S was conveyed into sheet stacking apparatus B from image forming apparatus A.

Conveyance route switching gate G2 switches the conveyance routes for sheet S, between conveyance route r2 conveying sheet S to upper tray 10A, and conveyance route r3 conveying sheet S to main tray 10B. Sheet S passing through conveyance route r2 is ejected onto upper tray 10A and stacked on upper tray 10A.

Sheet S, passing through conveyance route r3, is first conveyed to intermediate tray 20. Intermediate tray 20, which functions as a temporary stacking section, is capable of temporarily stacking plural sheets S. Accordingly, without reducing the number of sheets, sent from image forming apparatus A per unit time, and without ejecting sheets S to main tray 10B, said image forming system can receive sheets S, sent from image forming apparatus A, within sheet stacking apparatus B. Further, sorting plate 20A of intermediate tray 20 is capable of sorting sheets S as a single unit, to be ejected onto main tray 10B. The sorting operation of sorting plate 20A will be detailed later. In addition, if a stapling operation is to be conducted on plural sheets S which have been temporarily stacked on intermediate tray 20, stapling members 20D and 20E are operated.

Sheets S, ejected from intermediate tray 20, are further ejected onto main tray 10B, and stacked on main tray 10B. Designation 30A shown in FIG. 1 represents an aligning plate, which aligns sheets S on main tray 10B. The aligning operation performed on main tray 10B will be detailed later.

Figure 2:
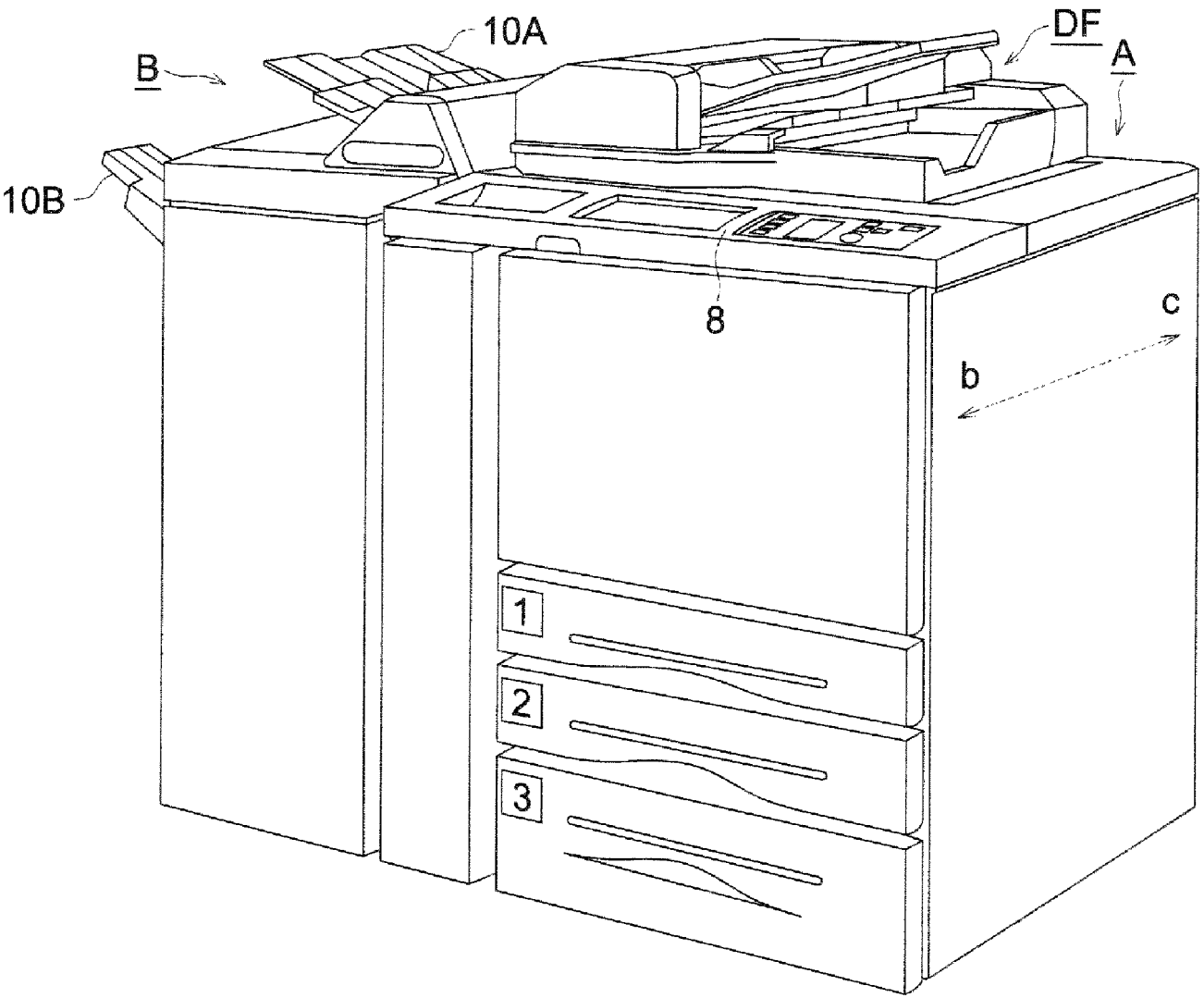
FIG. 2 is the exterior perspective view of said image forming system.

FIG. 2 is a perspective view of the image forming system. In this specification of the present invention, both "the front side of image forming apparatus A" and "the front side of sheet stacking apparatus B" mean the front side for a position where the operator faces to operate the image forming system. That is, side "b" in FIG. 2, at the top of which operation display section 8 exists, is said front side. Further, both "the rear side of image forming apparatus A" and "the rear side of sheet stacking apparatus B" mean the rear side for the position where the operator faces to operate the image forming system. That is, side "c" in FIG. 2 is said rear side.

In FIG. 2, operation display section 8 is installed on the front side of image forming apparatus A. Operation display section 8 displays various functions, such as operational jobs to be conducted in the image forming system, as well as sorting operation and aligning operation conducted in sheet stacking apparatus B, which are determined by the operator.

[Block Diagram of the Image Forming System]

Figure 3:
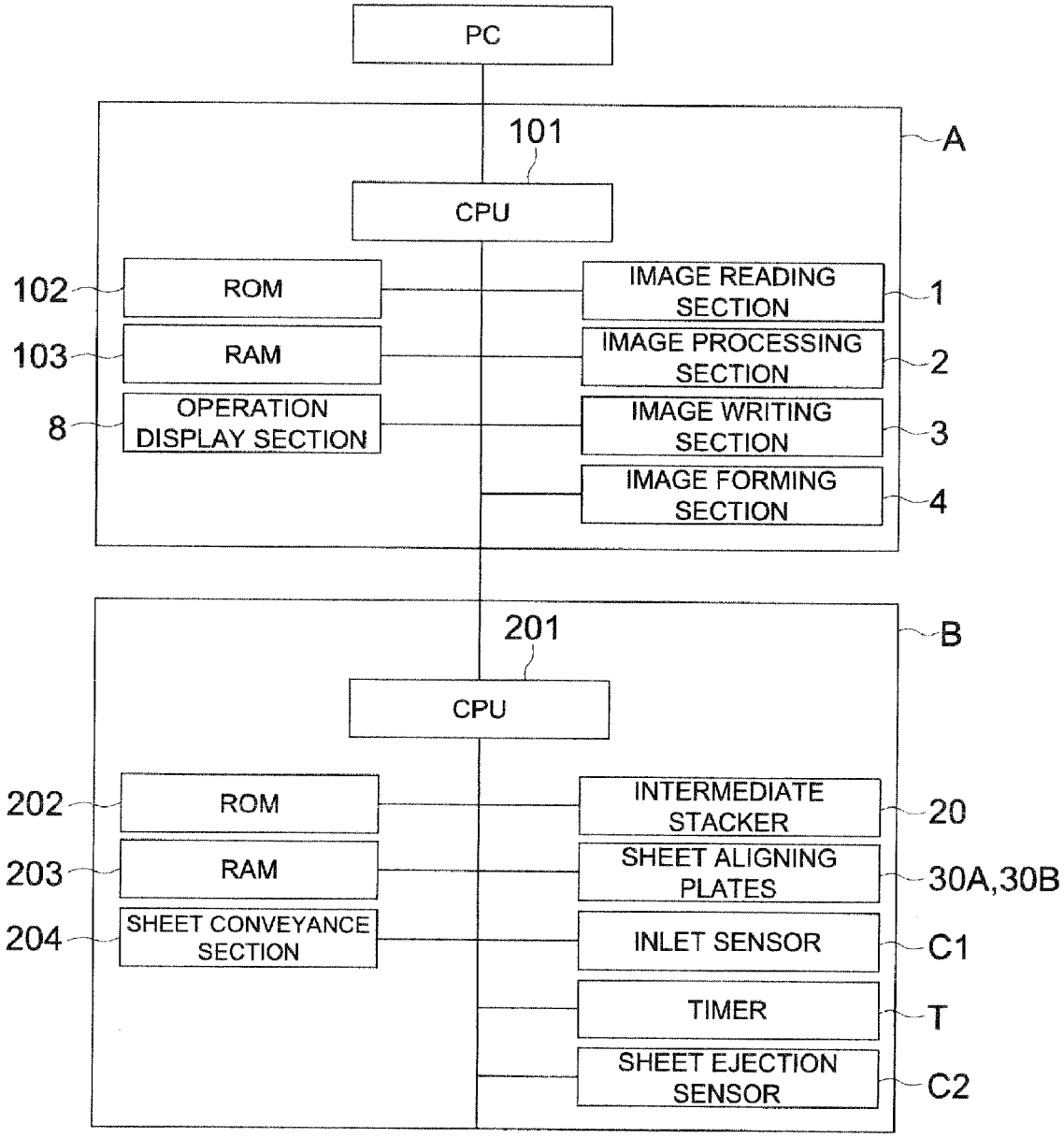
FIG. 3 is the block diagram of a control system of the image forming system.

FIG. 3 is the block diagram of the control system of the image forming system, in which typical blocks are shown.

Terminal machine PC, such as a personal computer, is connected to image forming apparatus A through a network. CPU (being Central Processing Unit) 101, which controls the total operation of image forming apparatus A, is connected to ROM (being Read Only Memory) 102, RAM (being Random Access Memory) 103, and the like. Said CPU 101 reads out various control programs stored in ROM 102, and expands them onto RAM 103 to control the operation of each section. Further, CPU 101 conducts various processes in accordance with the programs expanded in RAM 103, and stores the processed results in PAM 103. Still further, CPU 101 allows predetermined saving destinations to save the processed results stored in PAM 103.

Image data, generated in image reading section 1, and image data, sent from PC connected to image forming apparatus A, are processed by image processing section 2. Image forming section 4 receives the image data processed by image processing section 2, and forms an image on sheet S1.

CPU 201 of sheet stacking apparatus B works with ROM 202 and RAM 203, and controls the total operation of sheet stacking apparatus B, and CPU 201 conducts a series of other operations, based on signals sent from image forming apparatus A. CPU 201 reads out the various control programs stored in ROM 202, and expands them onto RAM 203, to control the various sections, such as intermediate tray 20, aligning plates 30A and 30B, and the like. In the present embodiment, since CPU 201 works with ROM 202 and RAM 203, CPU 201 functions as "the control section".

Timer T receives signals from sheet inlet sensor C1, to count the time interval between a foregoing sheet and a following sheet which pass through conveyance route r1. In the present embodiment, both timer T and inlet sensor C1 function as "the detecting section".

[General Outline of the Sheet Sorting Operation]

Figure 4:
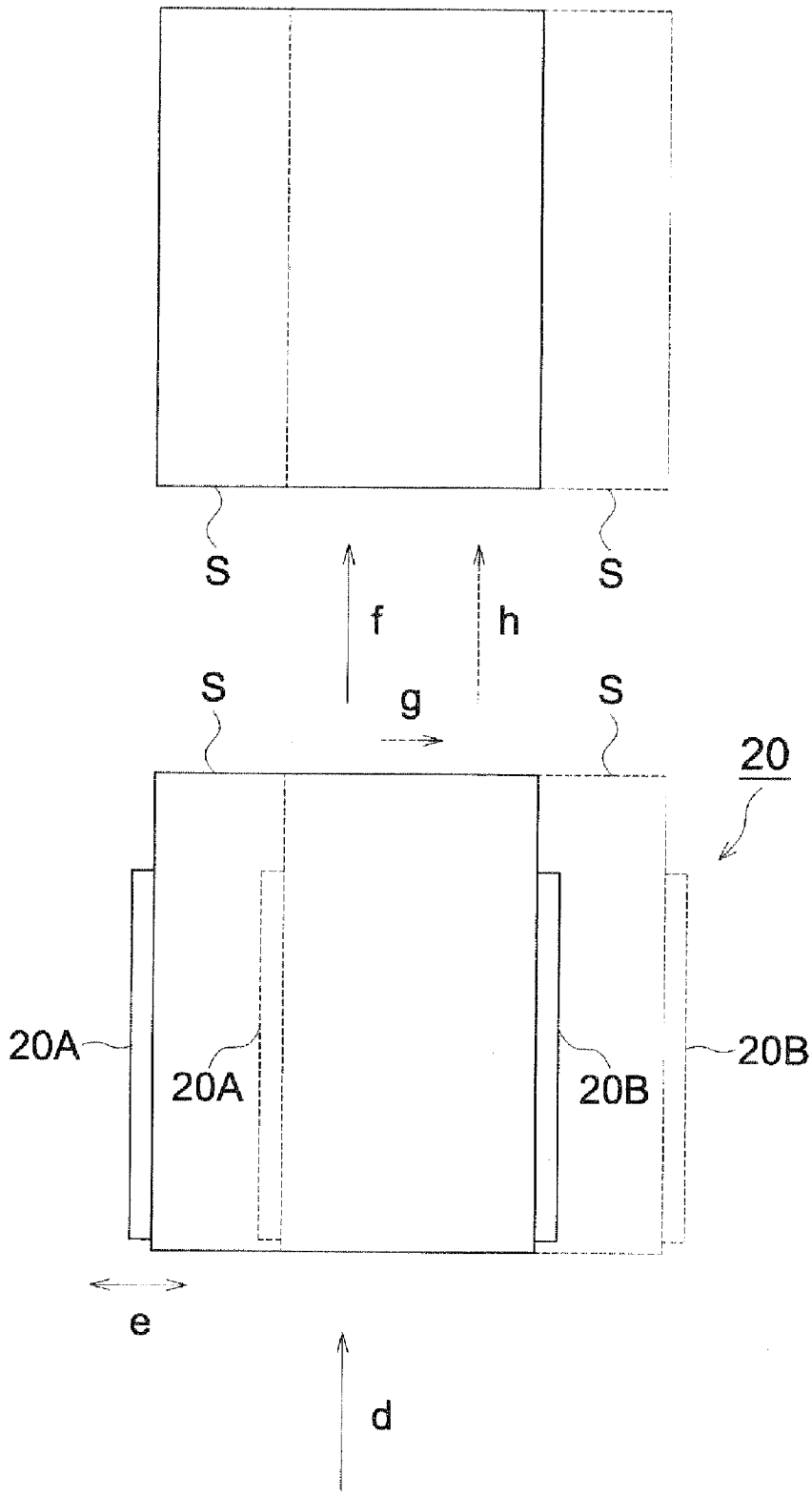
FIG. 4 is the plain view of a sorting plate of an intermediate stacker, viewed from the top.

The sheet sorting operation will now be detailed, in which the ejecting positions of sheets S stacked on main tray 10B are changed so that sheets S are sorted. FIG. 4 is a plain view of sorting plates 20A and 20B of intermediate tray 20, viewed from the top. The left side in FIG. 4 represents the front side (being side "b" in FIG. 2) of sheet stacking apparatus B, while the right side in FIG. 4 represents the rear side (being side "c" in FIG. 2) of sheet stacking apparatus B.

Sheets S, passing through conveyance route r3 of sheet stacking apparatus B (See FIG. 1), are conveyed in direction "d" in FIG. 4, and reach intermediate tray 20. After that, sheets S are sorted at two positions, being the front side and the rear side, and ejected onto main tray 10B.

In case that sheets S, having reached intermediate tray 20, are to be ejected onto the front side of sheet stacking apparatus B, sheets S are aligned one by one at the position shown by the solid lines in the lower figure of FIG. 4. The aligning operation of intermediate tray 20 is conducted by sorting plates 20A and 20B, both function as the sorting section. After the position of sorting plate 20B is fixed, sorting plate 20A is controlled to reciprocate, in direction "e" in FIG. 4, so that a side of sheet S is pushed and aligned. After that, sheet S is conveyed in direction "f", and is ejected onto the front side of sheet stacking apparatus B, which is shown by the solid lines in the upper figure of FIG. 4.

On the other hand, in case that sheets S, having reached intermediate tray 20, are to be ejected onto the rear side of sheet stacking apparatus B, sheet S is shifted by sorting plates 20A and 20B, from the position shown by the solid lines to the position shown by the dotted lines, (that is, sheet S is shifted in direction "g") Said shifting operations are conducted by a motor (which is not illustrated) which drives sorting plates 20A and 20B in the horizontal direction. Sheets S are aligned one by one at the position shown by the dotted lines in FIG. 4. The aligning operation is conducted by sorting plates 20A and 20 B, as explained above. After that, sheet S is conveyed in direction "h", and is ejected onto the rear side, which is shown by the dotted lines in the upper figure of FIG. 4, of sheet stacking apparatus B.

Accordingly, based on the printing job, determined by the operator, to be conducted on the image forming system, sorting plates 20A and 20B change the ejecting position of sheet S, whereby sheets S stacked on main tray 10B are sorted.

Further, after plural sheets S (for example, two sheets) are superimposed on intermediate tray 20, said plural sheets S can also be ejected onto main tray 10B in a superposed condition.

[General Outline of Sheet Aligning Operation]

Figure 5:
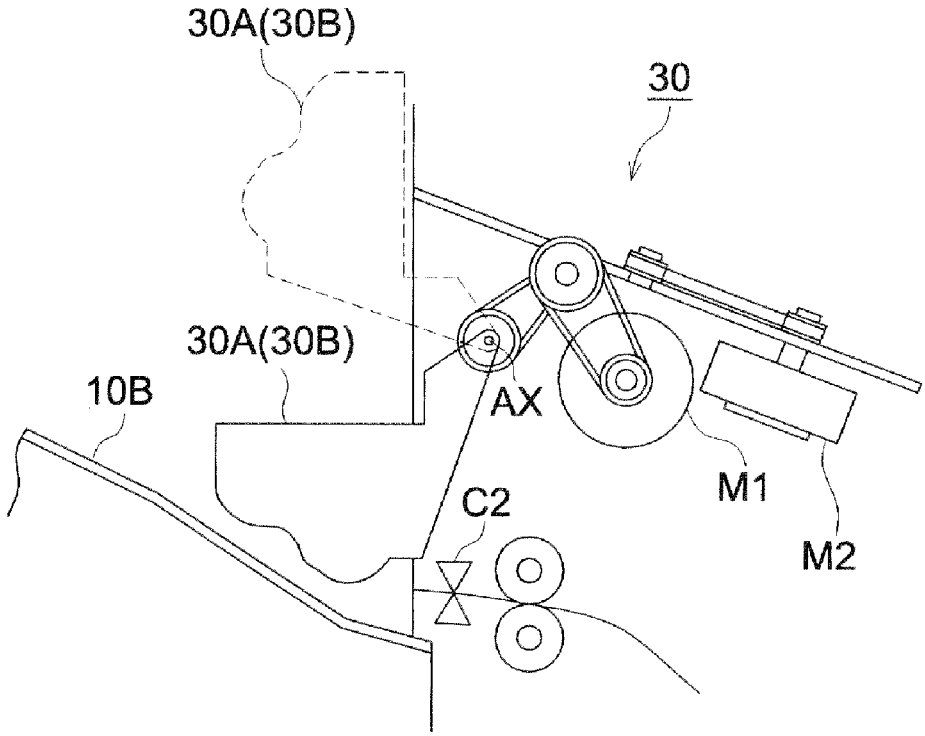
FIG. 5 (*a*) is the enlarged view of an aligning plate and its circumference.
Figure 5:
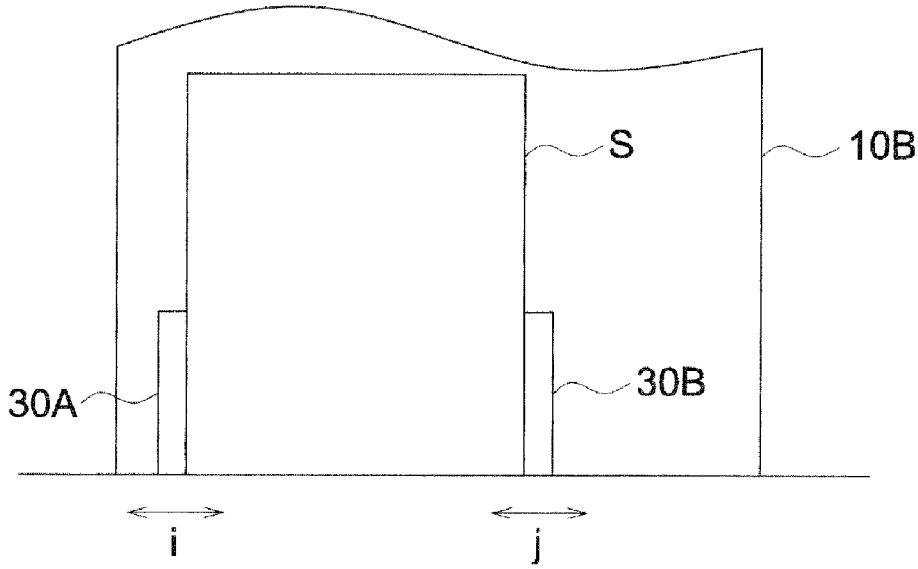

The aligning operation of sheets S, which were sorted by sorting plates 20A and 20B, and ejected onto main tray 10B, will now be detailed. FIG. 5 (*a*) is the enlarged view of aligning plates 30A and 30B and their circumference, while FIG. 5(*b*) is the top view of main tray 10B.

After the top surface of sheets S stacked on main tray 10B is detected by a sensor (which is not illustrated), main tray 10B moves vertically so that the top surface of sheets S is adjusted to be a predetermined height. The vertical movement of main tray 10B is conducted by a motor, which is not illustrated.

A pair of aligning plates 30A and 30B (functioning as the aligning section), which horizontally reciprocate perpendicular to the ejecting direction of sheet S, are installed above main tray 10B (that is, aligning plate 30A represents a first aligning plate, and aligning plate 30B represents a second aligning plate). Aligning plates 30A and 30B are pivoted on rotating shaft AX, and both of which rotate from the alignment position shown by the solid line to upper shunting positions shown by the dotted line in FIG. 5(*a*). Aligning plates 30A and 30B are rotated by motor M1 between the alignment position and the upper shunting position.

Aligning plates 30A and 30B reciprocate in the directions shown by arrows "i" and "j" in FIG. 5(*b*), (that is, based on an alignment position requested by the operator, either aligning plate 30A or 30B reciprocates), whereby a side of sheet S, stacked on main tray 10B, is pushed by aligning plate 30A or 30B, so that said sheet S is aligned. The reciprocating movement of aligning plates 30A and 30B is conducted by motor M2 shown in FIG. 5(*a*), that is, by a transferring mechanism of a belt and a pulley, the driving force of motor M2 is transferred to aligning plates 30A and 30B. In the present embodiment, motor M1 and motor M2 serve as "movement sections".

Sheet ejection sensor C2 is installed on a sheet conveyance route to detect sheet S which is to be ejected onto main tray 10B. Based on detection signals which are sent from sheet ejection sensor C2, CPU 201 counts the number of sheets S to be ejected onto main tray 10B. When the counted number reaches a predetermined value, sheets S must be aligned at another position, whereby CPU 201 controls motors M1 and M2 to move aligning plates 30A and 30B to another position.

The aligning operation of sheets S will now be detailed below, in which sheets S are continuously aligned at the front side and the rear side of sheet stacking apparatus B. A sheet unit, which is structured of sheets S which were sorted on main tray 10B, is referred to as "a sheet bundle" in the explanation below.

Figure 6:
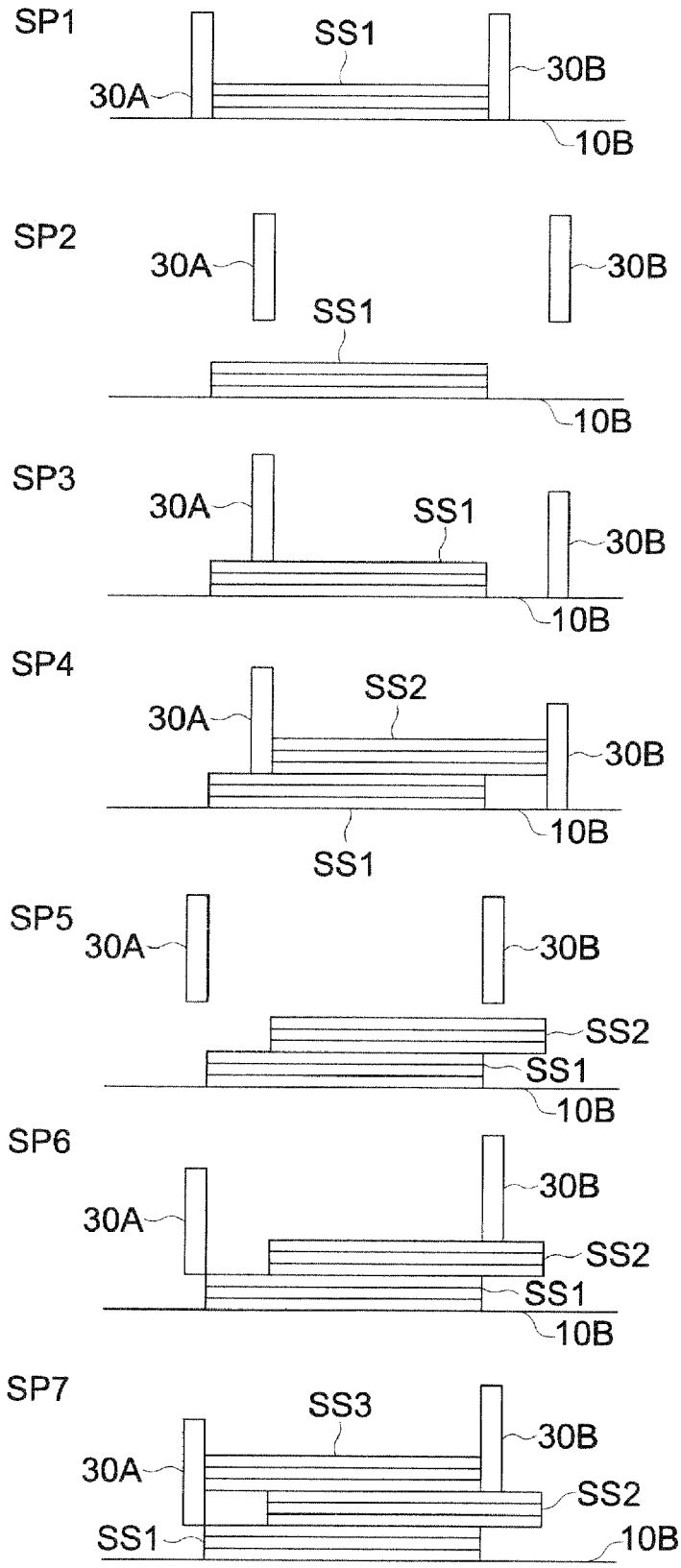
FIG. 6 shows aligning operations which can be conducted on each bundle of sheets on the main tray.

FIG. 6 shows aligning operations to be conducted on each sheet bundle on main tray 10B. The left side in FIG. 6 represents the front side (which is shown by "b" in FIG. 2) of sheet stacking apparatus B, while the right side is in FIG. 6 represents the rear side (which is shown by "c" in FIG. 2) of sheet stacking apparatus B.

As shown in step SP1 in FIG. 6, sheet bundle SS1, sorted by sorting plates 20A and 20B of intermediate tray 20, is stacked on the left side (which is the front side of sheet stacking apparatus B) of main tray 10B. When sheets S, which structure sheet bundle SS1, are ejected onto main tray 10B, sheets S are aligned by aligning plates 30A and 30B, whereby the edges of sheets S, structuring sheet bundle SS1, are mutually aligned.

Based on signals coming from sheet ejection sensor C2 which is installed upstream of main tray 10B, when the number of sheets S included in sheet bundle SS1 reaches the predetermined value, aligning plates 30A and 30B rotate upward and move to the right side (which is the rear side of sheet stacking apparatus B), as shown in step SP2. The horizontal moving distance of aligning plates 30A and 30B is equal to the horizontal moving distance of sorting plates 20A and 20B of stacker 20, which move for the sorting operation.

After aligning plates 30A and 30B move a predetermined distance, as shown in step SP3, lower ends of aligning plates 30A rotates downward, so that aligning plate 30A comes into contact with the top surface of sheet bundle SS1, while aligning plate 30B becomes lower than aligning plate 30A. After that, as shown in step SP4, sheet bundle SS2, which was sorted by sorting plats 20A and 20B of intermediate tray 20, is placed on sheet bundle SS1. In the same way as the case of sheet bundle SS1, when sheets S, which structure sheet bundle SS2, are ejected onto main tray 10B, sheets S are aligned by aligning plates 30A and 30B, whereby the edges of sheets S, structuring sheet bundle SS2, are mutually aligned.

Further, when each sheet S is ejected toward the left side (being the front side of sheet stacking apparatus B) of main tray 10B as the aligning operation, as shown in steps SP5 and SP6, aligning plates 30A and 30B are rotated upward and moved horizontally, and after that, aligning plates 30A and 30B are rotated to move downward, sheet bundle SS3, which was sorted by sorting plates 20A and 20B, is placed on sheet bundle SS2, as shown in step SP7. Due to the above described procedures, sheets S are sorted and aligned at two positions, being the front side and the rear side, of sheet stacking apparatus B.

Figure 7:
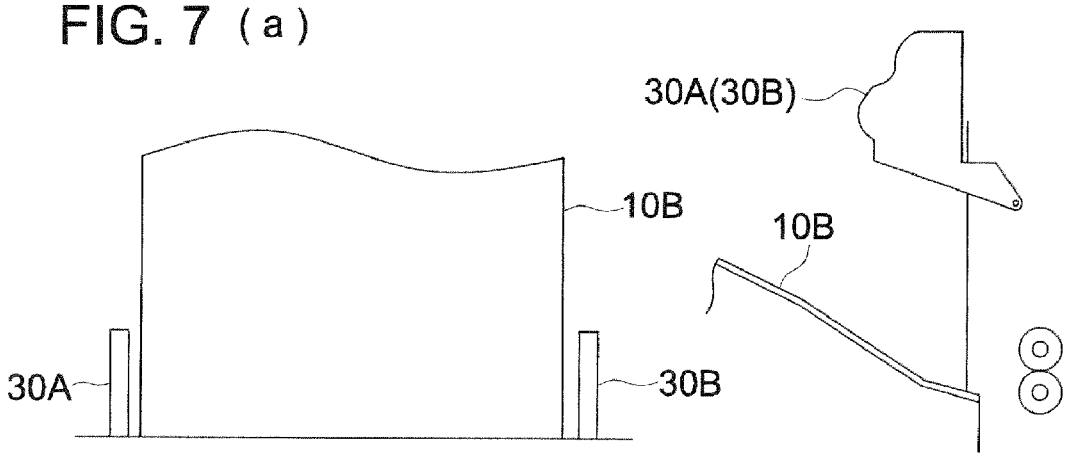
FIGS. 7(*a*), 7(*b*) and 7(*c*) are the plain views of the main tray, and the corresponding side views of the main tray and the aligning plate.
Figure 7:
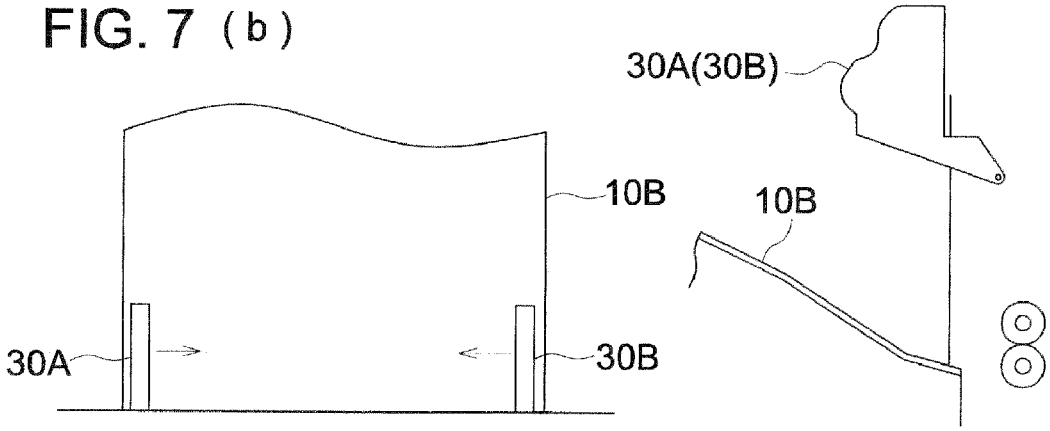
Figure 7:
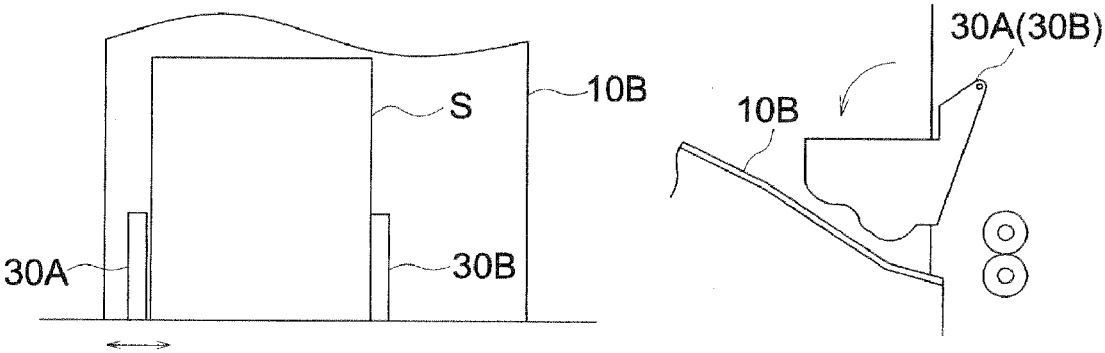
Figure 8:
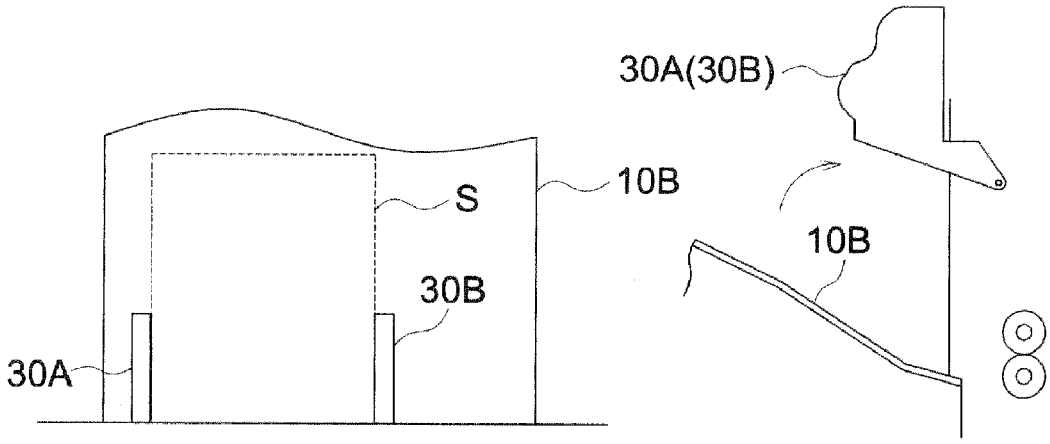
FIGS. 8(*a*), 8(*b*) and 8(*c*) are the plain views of the main tray, and the corresponding side views of the main tray and the aligning plate.
Figure 8:
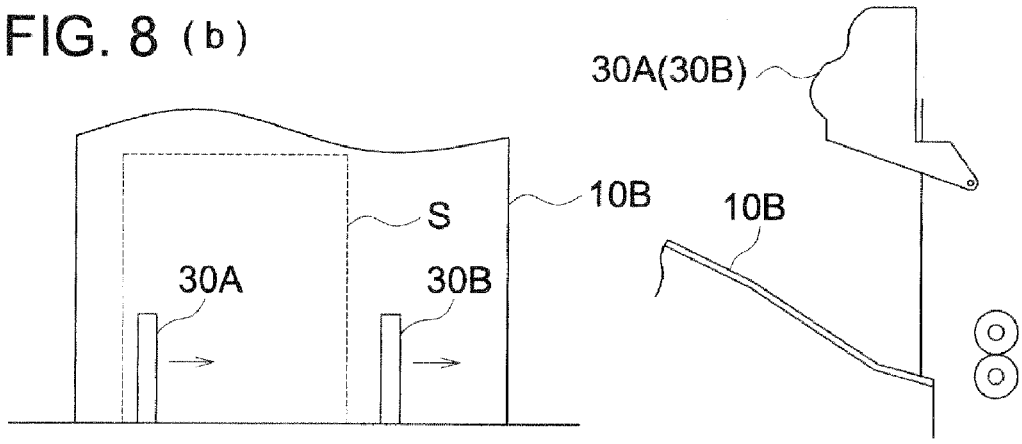
Figure 8:
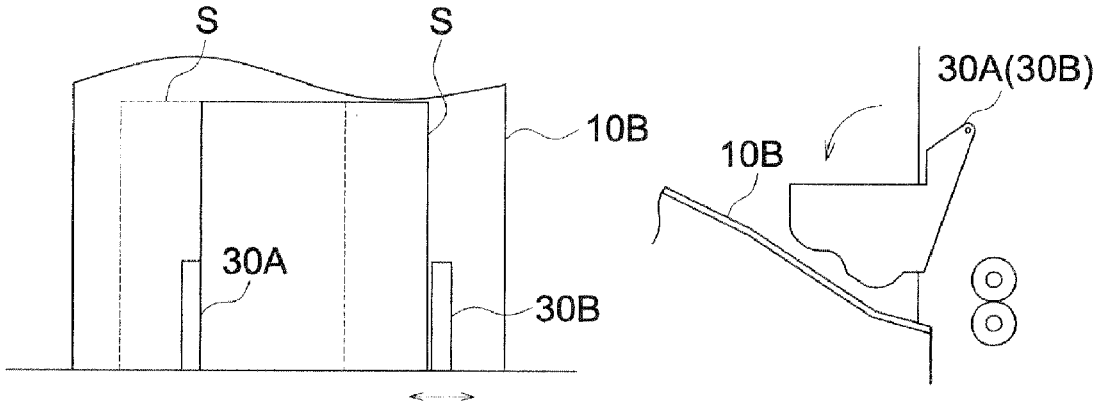

In order to detail the rotating movement, namely being moved upward and downward, and the aligning operation, of aligning plates 30A and 30B, FIGS. 7 and 8 are used in which aligning plates 30A and 30B are viewed from the side. The left figures in both FIG. 7 and FIG. 8 represent the plain views viewed from the top of main tray 10B, while the right figures in both FIG. 7 and FIG. 8 represent the enlarged side view of main tray 10B and aligning plates 30A and 30B. For the explanation using FIG. 7 and FIG. 8, sheets S are firstly stacked on the front side of sheet stacking apparatus B, after which sheets S are stacked on the rear side of sheet stacking apparatus B.

As shown in the left figure in FIG. 7(*a*), before the printing job is conducted on the image forming system, aligning plates 30A and 30 stand by at their home positions, which exist outside of main tray 10B. That is, aligning plates 30A and 30B stand by at their home positions, being the upper shunting positions.

When the printing job is conducted on the image forming system, and when the aligning operation is conducted by aligning plates 30A and 30B of main tray 10B, as shown in the left figure in FIG. 7(*b*), aligning plates 30A and 30B move horizontally toward the first sheet ejecting position (being the left side in FIG. 7). While said horizontal movement, aligning plates 30A and 30B still keep the height, as shown in the right figure in FIG. 7(*b*).

When aligning plates 30A and 30B reach the first sheet ejecting position, being the front side of sheet stacking apparatus B (being the left side in FIG. 7), aligning plates 30A and 30B rotate downward, and are positioned at the alignment position, as shown in the right figure of FIG. 7(*c*). That is, sheet S is ejected onto the front side of sheet stacking apparatus B, based on the position of aligning plate 30B, and the edge of sheet S is pushed by aligning plate 30A, which reciprocates horizontally, so that sheet S is aligned.

When aligning plates 30A and 30B move from the positions shown in FIG. 7(*c*) to the rear side of sheet stacking apparatus B, aligning plates 30A and 30B firstly rotate toward the upper shunting positions at the front side of sheet stacking apparatus B as shown in FIG. 8(*a*). After that, as shown in FIG. 8(*b*), when aligning plates 30A and 30B have reached the upper shunting positions, aligning plates 30A and 30B move toward the rear side of sheet stacking apparatus B (the right figure in FIG. 8). When aligning plates 30A and 30B have reached positions which are above the sheet ejecting position on the rear side of sheet stacking apparatus B, aligning plates 30A and 30B rotate to the lower alignment position, whereby aligning plates 30A and 30B are set at the alignment positions, as shown in FIG. 3(*c*). That is, sheet S is ejected onto the rear side of sheet stacking apparatus B, based on the position of aligning plate 30A, and the edge of sheet S is pushed by aligning plate 30B, so that sheet S is aligned.

[Operation for Determining Whether the Aligning Operation is to be Conducted]

As described above, in order to conduct the sheet aligning operation, aligning plates 30A and 30B move between the front side and the rear side of main tray 10B. That is, the horizontal movement of aligning plates 30A and 30B must be completed before sheet S is ejected onto main tray 10B. However, said horizontal movement requires a predetermined time. While a printing job, in which sheets S are continuously conveyed to sheet stacking apparatus B, is conducted, in order to allow sufficient horizontal moving time for alignments plate 30A and 30B, it is necessary, in some situations, to stack plural sheets S on intermediate tray 20, while no sheet S is ejected onto main tray 10B.

However, if a sheet bundle is structured of a single sheet, said single sheet is mixed into sheets S which structure other sheet bundle, whereby said single sheet cannot be temporarily stacked on intermediate tray 20. Accordingly, it is not possible to obtain time to horizontally move aligning plates 30A and 30B. To overcome this problem, the number of sheets which structure the sheet bundle is studied. If the number of sheets to be sorted as a single unit is one, aligning plates 30A and 30B are controlled not to conduct the aligning operation. This control will be detailed below, while referring to FIG. 9-11.

Figure 9:
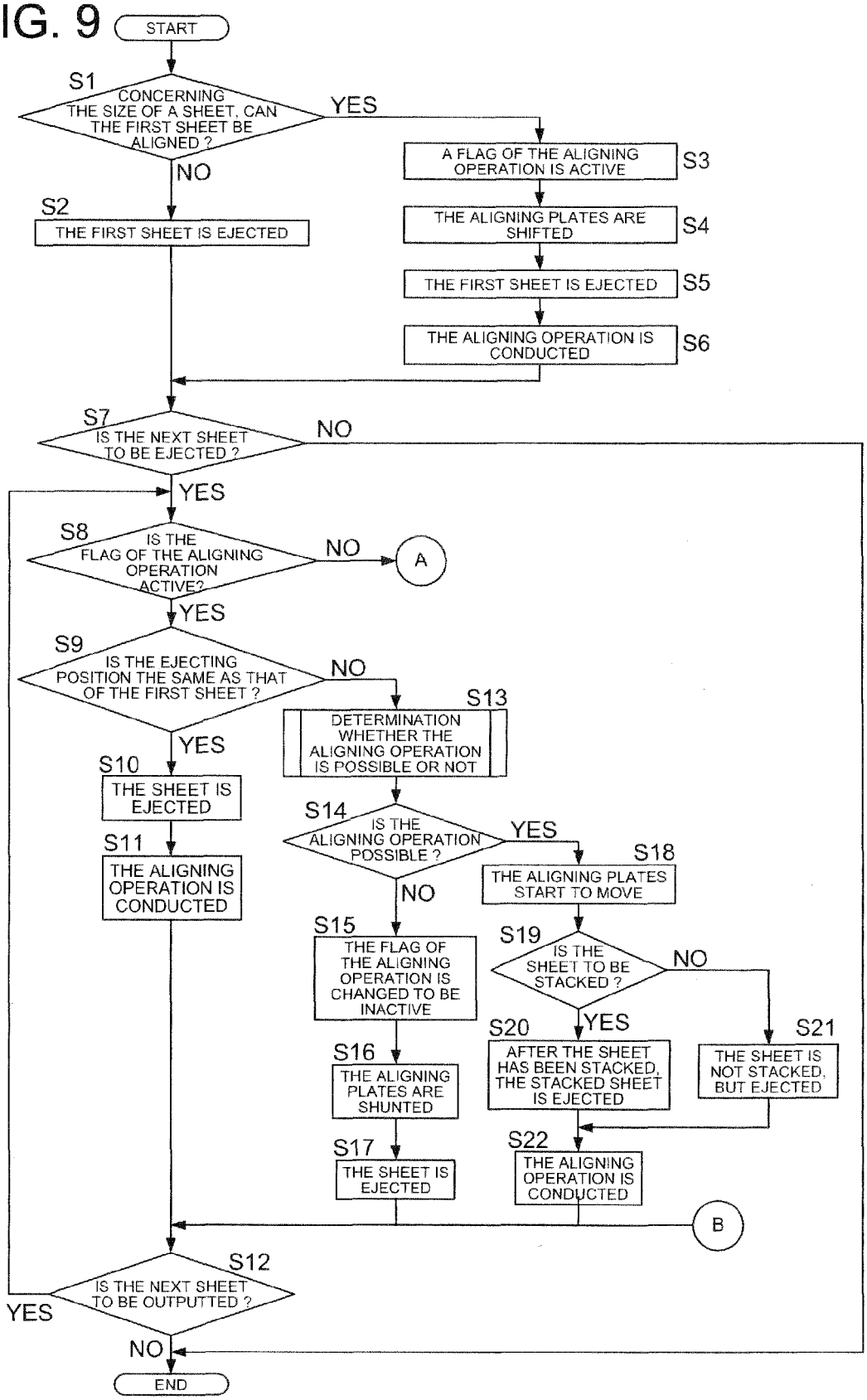
FIG. 9 is the flow chart of the operational steps of the sheet alignment conducted by the aligning plate.

FIG. 9 is the flow chart of the operational steps of the sheet alignment conducted by aligning plates 30A and 30B Determination steps (which are steps S1, S7-S9, S12, S14 and S19) in FIG. 9 are conducted by CPU 201, ROM 202 and RAM 203, of sheet stacking apparatus B, based on predetermined programs.

Concerning a leading sheet which is firstly conducted by the printing job of the image forming system, CPU 201 determines whether said leading sheet has a size which is possible to be aligned by aligning plates 30A and 30B (step S1). The operation in step S1 is conducted based on attribute information of the printing job. If the size is determined to be impossible to be aligned by aligning plates 30A and 30B ("No" in step S1), the leading sheet S is directly ejected onto main tray 10B (step S2). At this time, alignments plates 30A and 30B remain in their home positions, shown in FIG. 7(*a*).

If the size is determined to be possible to be aligned by aligning plates 30A and 30B ("Yes" in step S1), the flag of the aligning operation is turned ON, based on command from CPU 201 (step S3), so that information showing flag ON is temporarily stored in RAM 203. Based on attribute information of the printing job, motor M2 is controlled so that aligning plates 30A and 30B are shifted to the alignment positions (step S4). Subsequently, leading sheet S is ejected onto main tray 10B (step S5), and the aligning operation is conducted by aligning plates 30A and 30B (step S6).

Next, based on attribute information of the printing job, CPU 201 determines whether subsequent sheet S is to be ejected onto main tray 10B (step S7). If said subsequent sheet S is determined not to be ejected onto main tray 10B ("No" in step S7), the sequence of the operational steps is completed.

If said subsequent sheet S is to be ejected onto main tray 10B (Yes in step S7), CPU 201 determines whether the flag of the aligning operation is "ON" or "OFF", based on information stored in RAM 203 (step S8). The following control operation becomes different, due to the determined result of "ON" or "OFF".

If the flag of the aligning operation is not "ON" in step S8 ("No" in step S8), the operation flow goes to the flowchart shown in FIG. 11, which flowchart will be detailed later.

If the flag of the aligning operation is "ON" in step S8 ("Yes" in step S8), CPU 201 determines whether an ejecting position of said subsequent sheet S on main tray 10B is equal to the position of foregoing sheet S (step S9). The operation in step S9 is conducted, based on attribute information of the printing job.

If the ejecting position of said subsequent sheet S on main tray 10B is equal to the position of foregoing sheet S ("Yes" in step S9), aligning plates 30A and 30B need not be horizontally shifted to other positions, and subsequent sheet S is ejected onto the equal position on main tray 10B (step S10), whereby the aligning operation is conducted by aligning plates 30A and 30B (step S11).

If the ejecting position of said subsequent sheet S on main tray 10B is not equal to the position of foregoing sheet S (No in step S9), aligning plates 30A and 30B must be horizontally shifted to other positions. That is, said subsequent sheet S and its following sheets to be ejected onto main tray 10B are included in another sheet bundle. In this case, based on the number of sheets S within the sheet bundle to be ejected onto main tray 10B, the horizontal movement of aligning plates 30A and 30B may be not completed by the time when the subsequent sheet S is ejected. If such case happens, said subsequent sheet S to be ejected interferes with aligning plates 30A and 30B. Accordingly, the determining operation is conducted whether aligning operation should be conducted by aligning plates 30A and 30B (step S13). Said determining operation will be detailed below.

Figure 10:
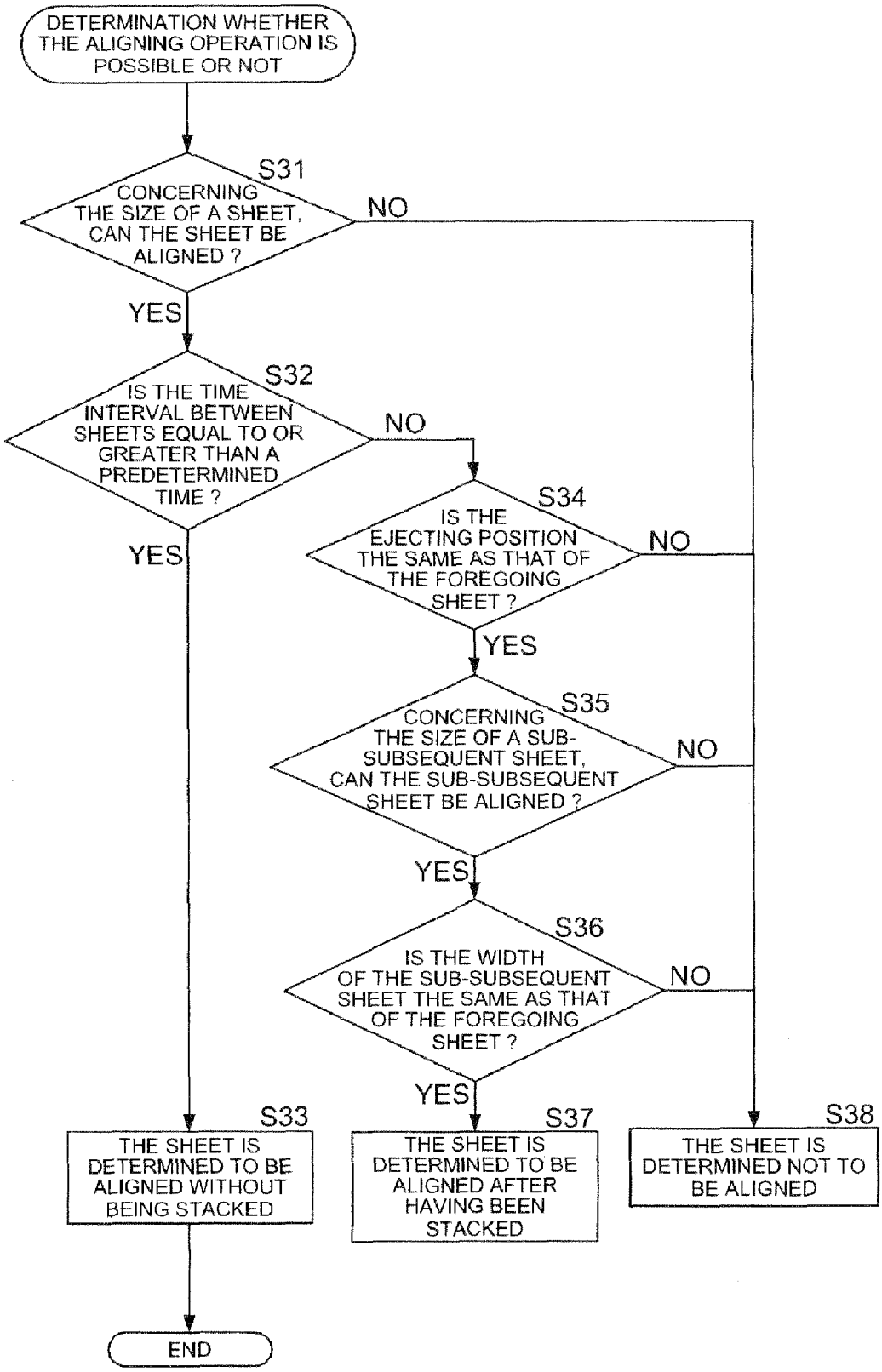
FIG. 10 is the flow chart to determine whether the sheet aligning operation is to be conducted or not by the aligning plates.

FIG. 10 is the flow chart to determine whether the aligning operation should be conducted by aligning plates 30A and 30B. Determination steps (which are steps S31, S32, S34-S36) in FIG. 10 are conducted by CPU 201, ROM 202 and RAM 203, of sheet stacking apparatus B, based on predetermined programs.

CPU 201 compares the size of subsequent sheet S to that of foregoing sheet S which was ejected onto main tray 10B, and determines whether the size of subsequent sheet S is possible to be aligned by aligning plates 30A and 30B (step S31).

If CPU 201 determines that the size of subsequent sheet S is impossible to be aligned by aligning plates 30A and 30B (No in step S31), CPU 201 determines that the aligning operation with regard to said subsequent sheet S is impossible (step S38). The determined result is temporarily stored in RAM 203.

If, in step S31, CPU 201 determines that the size of subsequent sheet S is possible to be aligned by aligning plates 30A and 30B (Yes in step S31), CPU 201 determines whether a time interval (being the time interval between sheets), which is the time between a passing time point of foregoing sheet S and that of subsequent sheet S at inlet sensor C1 of sheet stacking apparatus B, is equal to or greater than a predetermined time (step S32). Said time interval is measured by inlet sensor C1 and timer T.

If the time interval between the sheets is equal to or greater than the predetermined time in step S32 (Yes in step S32), time can be secured to shift aligning plates 30A and 30B to another position, so that it is not necessary for subsequent sheet S to be stacked on intermediate tray 20, nor to delay the ejection of subsequent sheet S onto main tray 10B. Accordingly CPU 201 determines that the aligning operation can be conducted onto subsequent sheet S, without stacking subsequent sheet S on intermediate tray 20 (step S33). That is, even though the number of sheets within a single unit to be sorted is only one, the aligning operation is conducted.

If the time interval between the sheets is less than the predetermined time in step S32 ("No" in step S32), a time, in which aligning plates 30A and 30B are shifted to another position, can or cannot be secured, based on the number of sheets within the sheet bundle in which the subsequent sheet S is included. Accordingly, referring to information of sheet S which will be ejected after subsequent sheet S, (hereinafter, referred to as "sub-subsequent sheet S"), CPU 201 conducts the determination steps, being steps S34-S36.

CPU 201 determines whether the ejecting position of subsequent sheet S is equal to that of sub-subsequent sheet S, on main tray 10B (step S34). If the ejecting position is not equal in step 34 ("No" in step S34), subsequent sheet S falls into a sheet bundle structured of only a single sheet. Accordingly, said subsequent sheet S should not be included within other sheets S on intermediate tray 20, and the ejection of subsequent sheet S should not be delayed on main tray 10B, due to the control in sheet stacking apparatus B. Further, since said unit is structured of a single sheet S, aligning plates 30A and 30B do not need to align said single sheet on main tray 10B, whereby CPU 201 determines an impossible aligning operation (step S38).

If the ejecting position is equal in step 34 ("Yes" in step S34), subsequent sheet S is included in a sheet bundle structured of at least more than two sheets. That is, said subsequent sheet S can be stacked on intermediate tray 20, and included within other sheets which structure the same sheet bundle. Accordingly, subsequent sheet S is temporarily stacked on intermediate tray 20, so that the ejection of subsequent sheet S onto main tray 10B is delayed, whereby the time for shifting aligning plates 30A and 30B can be secured. Due to the above determinations, the flow goes to the determination step of step 35.

In step S35, CPU 201 determines whether sub-subsequent sheet S has a size which is able to be aligned, while in step S36, CPU 201 determines whether the width of subsequent sheet S is equal to that of sub-subsequent sheet S (wherein the width represents a width to be aligned by aligning plates 30A and 30B). If sub-subsequent sheet S does not include the size being able to be aligned ("No" in step S35), or if the width of subsequent sheet S is not equal to that of sub-subsequent sheet S ("No" in step S36), said subsequent sheet S falls into a sheet bundle structured of a single sheet. Accordingly, said subsequent sheet S should not be included with other sheets S on intermediate tray 20, and the ejection of subsequent sheet S cannot be delayed on main tray 10B, due to the control in sheet stacking apparatus B. Further, since said unit is structured of a single sheet S, aligning plates 30A and 30B do not need to align said single sheet on main tray 10B, whereby CPU 201 determines the aligning operation is impossible (step S38).

If sub-subsequent sheet S includes the size being able to be aligned ("Yes" in step S35), and if the width of subsequent sheet S is equal to that of sub-subsequent sheet S (Yes in step S36), said subsequent sheet S falls into a sheet bundle structured of at least more than two sheets Accordingly, said subsequent sheet S can be stacked and included with other sheets S structuring the same sheet bundle on intermediate tray 20. That is, subsequent sheet S can be temporarily stacked on intermediate tray 20, and the ejection of subsequent sheet S can be delayed on main tray 10B, whereby time for shifting aligning plates 30A and 30B can be secured. Due to the above determinations, subsequent sheet S is stacked on intermediate tray 20, and CPU 201 determines that the aligning operation is possible (step S37).

Turning to FIG. 9, the operation shown in the flowchart will be detailed below.

The operation in step S13, to determine whether the aligning operation was possible or impossible, was detailed above, while referring to FIG. 10. Based on the determined result in step S13, the aligning operation of the subsequent sheet S, which is to be ejected onto main tray 10B, is determined whether being possible or not in step S14.

If the aligning operation in step S14 is impossible ("No" in step S14), CPU 201 turns off the flag of the aligning operation (step S15), and temporarily stores information of the flag OFF in RAM 203. Further, CPU 201 controls motor 1 to rotate aligning plates 30A and 30B to the upper shunted positions [See FIG. 5(*a*)] (step S16). By this rotation, sheet S can be ejected onto main tray 10B, without being disturbed by aligning plates 30A and 30B. Still further, in step S16, it is effective not only to rotate aligning plates 30A and 30B to the upper shunted positions, but also to move aligning plates 30A and 30B to the home position shown in FIG. 7(*a*). After the operation of step S16, sheet S is ejected onto main tray 10B (step S17), and the operation flow goes to step S12.

If the aligning operation in step S14 is possible (Yes in step S14), in order to conduct the aligning operation at the other position, CPU 201 controls motor M1 to shift aligning plates 30A and 30B, based on attribute information of the printing job (step S18). After that, based on the determined result in step S13, CPU 201 determines whether sheet S is to be temporarily stacked on intermediate tray 20 (step S19).

Based on the determined result in step S19, any one of the operations listed below is conducted, in which: after sheet S is stacked on intermediate tray 20, plural superimposed sheets S (for example, two sheets) are ejected onto main tray 10B (step S20); or sheet S is ejected onto main tray 11B, without being stacked on intermediate tray 20 (step S21). After sheet S is ejected onto main tray 10B, CPU 201 activates aligning plates 30A and 30B to conduct the aligning operation (step S22). By the above operational procedures conducted in sheet stacking apparatus B, the sheet aligning operation is appropriately conducted.

Figure 11:
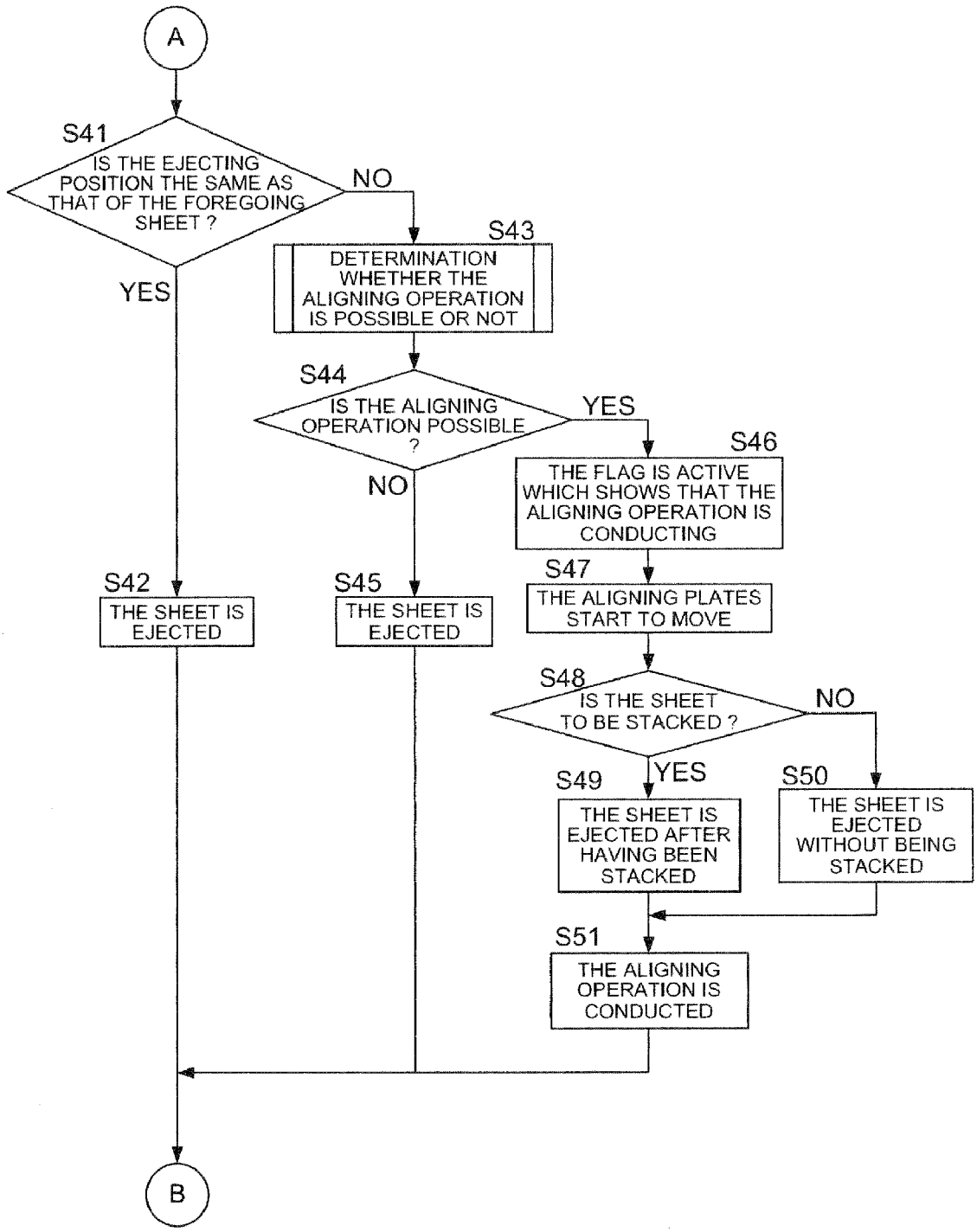
FIG. 11 is the flow chart to show the aligning operation has not been conducted, with respect to a previous sheet ejected onto the main tray.

The operation of the case, in that the flag of the aligning operation is not "ON" in step S8 (that is, "No" in step S8), will be detailed, while referring to the flowchart of FIG. 11.

FIG. 11 is the flow chart of the operational steps, in which the aligning operation with respect to a previous sheet, ejected onto main tray 10B, has not been conducted.

CPU 201 determines whether the ejecting position of subsequent sheet S is equal to that of previous sheet S on main tray 10B (step S41). The operation of step S41 is conducted, while referring to attribute information of the printing job.

In step S41, if the ejecting position of subsequent sheet S is equal to that of previous sheet S on main tray 10B (Yes in step S41), the aligning operation is not conducted, which is the same as for the case of previous sheet S, and subsequent sheet S is ejected onto the equal position on main tray 10B (step S42).

In step S41, if the ejecting position of subsequent sheet S is not equal to that of previous sheet S on main tray 10B (No in step S41), the operation to determine whether an aligning operation is possible or not, is conducted (step S43), which is the same operation shown in FIG. 10. Based on the determined result in step S43, the aligning operation of the subsequent sheet S, which is to be ejected onto main tray 10B, is determined whether being possible or not in step S44.

In step S44, if the aligning operation is determined to be impossible ("No" in step S44), the aligning operation is not conducted, and subsequent sheet S is ejected onto another position on main tray 10 (step S45). That is, to sort subsequent sheet S from previous sheet S, subsequent sheet S is shifted to another position by sorting plates 20A and 20B, whereby subsequent sheet S is ejected onto main tray 10B.

In step S44, if the aligning operation is determined possible ("Yes" in step S44), CPU 201 turns on the flag of the aligning operation (step S46), and temporarily stores information of flag ON in RAM 203. Then, CPU 201 controls motor M1 to shift aligning plates 30A and 30B, based on attribute information of the printing job (step S47). After that, based on the determined result in step S43, CPU 201 determines whether sheet S is to be temporarily stacked on intermediate tray 20 (step S48).

Based on the determined result in step S48, any one of the operations listed below is conducted, in which: after sheet S is stacked on intermediate tray 20, plural superimposed sheets S (for example, two sheets) are ejected onto main tray 10B (step S49); or sheet S is ejected onto main tray 10B, without being stacked on intermediate tray 20 (step S50). After sheet S is ejected onto main tray 10B, CPU 201 makes aligning plates 30A and 30B to conduct the aligning operation (step S51) By the above operational procedures conducted in sheet stacking apparatus B, the sheet aligning operation is appropriately conducted.

As detailed above, while referring to FIGS. 9-11, and in particular, to steps S34-S36 in FIG. 10, if the number of sheets, united in a single unit to be sorted on main tray 10B, is plural, after sheets S are stacked on intermediate tray 20, that is, after the time period to make aligning plates 30A and 30B to horizontally shift is secured, the aligning operation is conducted by aligning plates 30A and 30B. Due to these operations, sheet ejection timing can be controlled in sheet stacking apparatus B, whereby the number of sheets ejected from image forming apparatus A in a unit of time are not reduced, so that the aligning operation can be appropriately conducted.

Further, if the number of sheets S, united in a single unit to be sorted on main tray 10B, is singular, sheet S cannot be stacked on intermediate tray 20, that is, the required time period to shift aligning plates 30A and 30B horizontally cannot be secured, CPU 201 makes aligning plates 30A and 30B not to conduct the aligning operation. That is, since the unnecessary aligning operation is not conducted, it is not necessary to control sheet ejection timing in sheet stacking apparatus B, whereby the number of sheets ejected from image forming apparatus A in a unit of time is not reduced.

The above descriptions in the present embodiments show only an example of the sheet stacking apparatus relating to the present invention, and descriptions are not limited to these embodiments. These detailed structures and operations can be appropriately changed within the scope of this invention, as long as they do not deviate from the contents of the present invention.

What is claimed is:

1. A sheet stacking apparatus which is configured to align a sheet unit, the sheet unit including one sheet or plural sheets, the apparatus comprising:

a stacking section which is configured to stack sheets ejected outside;

a sorting section which is configured to change a sheet ejecting position of at least one sheet on the stacking section to sort the at least one sheet as a sheet unit;

an aligning section which is configured to align the at least one sheet sorted by the sorting section and ejected onto the stacking section;

a shifting section which is configured to shift the aligning section based on the sheet ejecting position on the stacking section;

a control section which is configured to control at least the aligning section and the shifting section, based on a time interval between successively conveyed sheets;

a conveyance route which is configured to convey the sheet toward the stacking section;

a detecting section which is configured to detect a time interval between a trailing edge of a preceding sheet and a leading edge of a following sheet conveyed successively through the conveyance route; and an intermediate stacking section which is provided upstream of the stacking section with respect to a sheet conveyance direction and which is configured to temporarily stack plural sheets and to convey said plural sheets to the stacking section;

wherein:

(i) when plural sheets are included in the sheet unit sorted by the sorting section, the control section controls the sorting section, the aligning section, the shifting section, and the intermediate stacking section such that while a foregoing sheet unit is completely ejected onto the stacking section to be aligned, a predetermined number of sheets in a following sheet unit are stacked on the intermediate stacking section and then ejected to the stacking section, and thereafter, sheets remaining in the following sheet unit are directly ejected onto the stacking section and stacked on the predetermined number of sheets on the stacking section, whereby all of the sheets in the following sheet unit are aligned on the stacking section, and (ii) when only one sheet is included in the sheet unit, the control section controls the aligning section and the shifting section not to align the one sheet.

2. The sheet stacking apparatus of claim 1, wherein the sorting section adjusts a position of the at least one sheet stacked on the intermediate stacking section so that the sheet ejecting position of the at least one sheet on the stacking section is changed.

3. The sheet stacking apparatus of claim 1, wherein the sorting section is adapted to sort sheets at two positions which correspond to a front position and a rear position of the sheet stacking apparatus.

4. The sheet stacking apparatus of claim 1, wherein the aligning section includes a first aligning plate and a second aligning plate, and at least one of the first aligning plate and the second aligning plate horizontally reciprocates perpendicularly to an ejecting direction of the at least one sheet, so that the at least one sheet is aligned.

5. An image forming system, comprising:

the sheet stacking apparatus of claim 1; and an image forming apparatus which is configured to convey sheets to the sheet stacking apparatus, after the image forming apparatus has formed images on the sheets.

* * * * *